US009189912B2

(12) United States Patent
Gunderson

(10) Patent No.: US 9,189,912 B2
(45) Date of Patent: Nov. 17, 2015

(54) COMPACT LID DISPENSER

(71) Applicant: Jeffrey E. Gunderson, Stoughton, WI (US)

(72) Inventor: Jeffrey E. Gunderson, Stoughton, WI (US)

(73) Assignee: The Vollrath Company, LLC, Sheboygan, WI (US)

( * ) Notice: Subject to any disclaimer, the term of this patent is extended or adjusted under 35 U.S.C. 154(b) by 105 days.

(21) Appl. No.: 13/714,146

(22) Filed: Dec. 13, 2012

(65) Prior Publication Data

US 2014/0166688 A1 Jun. 19, 2014

(51) Int. Cl.

| | |
|---|---|
| ***G07F 11/16*** | (2006.01) |
| ***G07F 13/10*** | (2006.01) |
| ***A47F 1/08*** | (2006.01) |

(52) U.S. Cl.

CPC ..... *G07F 11/16* (2013.01); *A47F 1/085* (2013.01); *G07F 13/10* (2013.01)

(58) Field of Classification Search

USPC ..... 221/208, 210, 221, 224, 226, 228, 279

See application file for complete search history.

(56) References Cited

U.S. PATENT DOCUMENTS

| | | | | | |
|---|---|---|---|---|---|
| 1,050,788 | A | * | 1/1913 | Baltzley | 221/293 |
| 1,609,581 | A | * | 12/1926 | Smith | 221/210 |
| 3,595,435 | A | * | 7/1971 | Graham, Jr. | 221/310 |
| 4,436,222 | A | * | 3/1984 | Taylor et al. | 221/223 |
| 5,012,952 | A | | 5/1991 | Franz | |
| 5,322,188 | A | * | 6/1994 | Dodaro | 221/223 |
| 5,383,571 | A | | 1/1995 | Gunderson | |
| 5,738,246 | A | * | 4/1998 | Chung | 221/222 |
| 5,960,989 | A | * | 10/1999 | Gunderson | 221/220 |
| 6,474,503 | B2 | * | 11/2002 | Davis | 221/223 |
| 6,824,007 | B2 | | 11/2004 | Timmers et al. | |
| 7,207,462 | B2 | * | 4/2007 | Gunderson et al. | 221/220 |
| 2005/0247724 | A1 | | 11/2005 | Gapp | |
| 2007/0068962 | A1 | * | 3/2007 | Gunderson et al. | 221/220 |
| 2007/0295746 | A1 | | 12/2007 | Gapp | |
| 2009/0057334 | A1 | | 3/2009 | Pearl et al. | |
| 2010/0187248 | A1 | | 7/2010 | Popp et al. | |
| 2011/0226799 | A1 | | 9/2011 | Watson et al. | |
| 2011/0284572 | A1 | | 11/2011 | Meyer et al. | |
| 2011/0299568 | A1 | * | 12/2011 | Huang et al. | 374/209 |

OTHER PUBLICATIONS

International Search Report and Written Opinion for Application No. PCT/US2013/074778, mail date Sep. 1, 2014, 9 pages.

* cited by examiner

*Primary Examiner* — Gene Crawford
*Assistant Examiner* — Kelvin L Randall, Jr.
(74) *Attorney, Agent, or Firm* — Foley & Lardner LLP

(57) ABSTRACT

A lid dispenser receives a stack of drink cup lids within a housing tube, such that the frontmost lids extend through a front element opening and are retained by multiple pager assemblies, each of which has a frontwardly extending pager body post. The inside of the pager body has an engaging wall with an inclined surface directed radially inwardly. Flippers are pivoted to the posts and have wings which extend towards the front element, and have interior surfaces which are inclined radially outwardly. The flippers are biased radially inwardly, but are displaceable by a pressure applied axially towards the interior cavity. When adjusted so the pager body posts project radially over the front element opening, each pager body post inside wall is positioned to engage lids which extend from the front element opening, and direct them towards engagement with the pager flippers.

16 Claims, 4 Drawing Sheets

FIG. 6
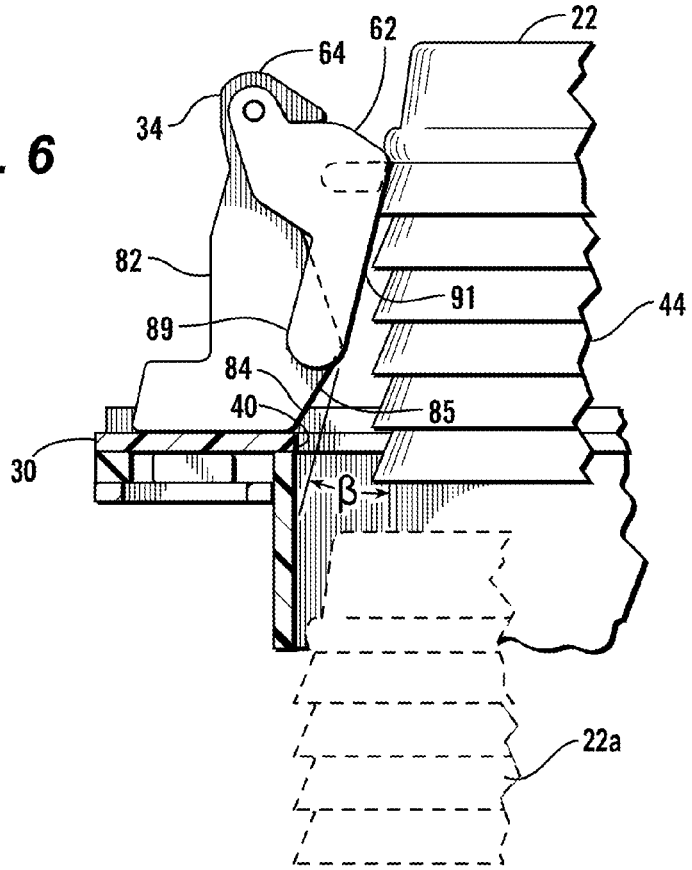
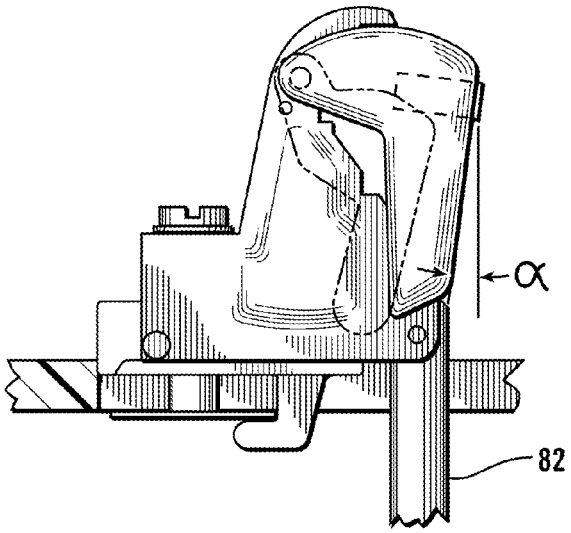
PRIOR ART
FIG. 7

COMPACT LID DISPENSER

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to devices for dispensing lids for containers generally, and especially for dispensing beverage containers lids.

In many convenience stores, restaurants, cafeterias, and other locations where beverages are sold, customers are allowed to serve themselves from beverage dispensers. The beverages are dispensed into disposable cups. To limit spilling of the beverages, especially for take-out orders, the cups are commonly sealed by the customer with a disposable plastic lid.

For reasons of convenience, efficiency, reduced waste, and improved hygiene, the beverage container lids are optimally dispensed from a lid dispenser which makes available a single lid while protecting the remaining supply of lids from contact with the customer. In U.S. Pat. Nos. 5,960,989; 5,383,571; and 7,207,462, the disclosures of which are incorporated by reference herein, lid dispensers are described which readily dispense single lids for consumer use. These lid dispensers are configured for ready adjustment to accommodate the wide variety of lid shapes and sizes found in the marketplace, in some cases without the use of tools.

In most retail environments, space is at a premium, making it desirable to offer a lid dispensing functionality in a compact apparatus. Not only would a more compact lid dispenser make better use of available space, but, because it would use less materials, it offers the possibility of reduced manufacturing costs.

SUMMARY OF THE INVENTION

A lid dispenser has an axially extending polygonal tube with an interior cavity configured to receive a stack of lids therein. A front element fixed to the tube has an opening therein through which lids are dispensed. A plurality of pager assemblies are mounted to the front element to project frontwardly therefrom and to engage lids presented at the housing opening. Each pager assembly has a pager body with a post which extends frontwardly from the front element. The inside of the pager body has an engaging wall which extends axially and radially inwardly, to define an inclined surface directed radially inwardly. Each pager assembly has a flipper pivotally mounted to the pager body post. The flippers have wings which extend towards the front element, and have interior surfaces which are inclined radially outwardly. The flippers are biased radially inwardly, but are displaceable by a pressure applied axially towards the interior cavity. The pager assemblies are adjustably mounted to the front element for positioning in a desired radial position, wherein when the assemblies are positioned such that the pager body posts project radially over the front element opening, each pager body post inside wall is positioned to engage lids which extend from the front element opening, and direct them towards engagement with the pager flippers.

Constant force springs are engaged with a polygonal piston with a standoff plate which urges the stack of lids frontwardly against the pagers through the front element. The polygonal tube abuts the front element, such that the circular opening permits the dispensing of lids, but restrains the polygonal piston from escaping frontwardly through the front plate opening.

It is an object of the present invention to provide a lid dispenser which can be readily adjusted to accommodate lids of different dimensions.

It is a further objection of the present invention to provide a lid dispenser which compactly accommodates a stack of lids.

Further objects, features and advantages of the invention will be apparent from the following detailed description when taken in conjunction with the accompanying drawings.

BRIEF DESCRIPTION OF THE DRAWINGS

FIG. 6 is a cross-sectional view of the device of FIG. 2, taken along section line 6-6.

FIG. 7 is a fragmentary cross-sectional view of the prior art pager assembly of the lid dispenser of U.S. Pat. No. 7,207,462.

DESCRIPTION OF THE PREFERRED EMBODIMENTS

Figure 1:
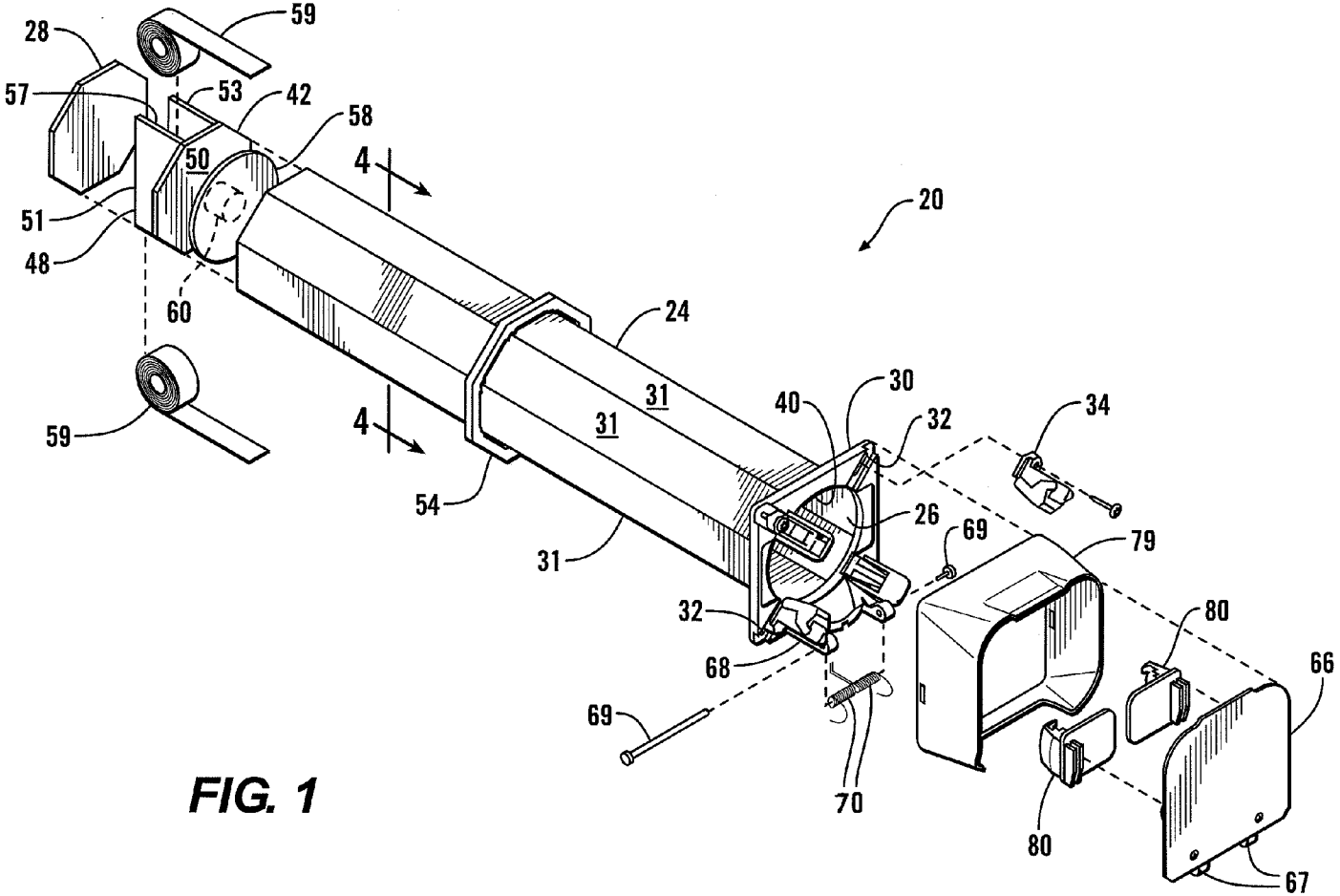
FIG. 1 is an exploded isometric view of the lid dispenser of this invention.

Referring more particularly to FIGS. 1-7, wherein like numbers refer to similar parts, a dispenser 20 of beverage container lids is shown in FIG. 1. The dispenser 20 has a tubular housing 24 which has an interior compartment 26 defined between a rear wall 28 and a front element 30. The front element 30 has four radially extending slots 32 which each receive an adjustable pager assembly 34. The slots 32 extend radially outwardly from a generally circular dispensing opening 40 which provides an outlet from the housing interior compartment 26. Each pager assembly 34 is positionable along a radial slot 32 and is fixed in place by a screw fastener 33 which extends through a slot 72 in the pager body 64 and engages with a threaded nut 35 which abuts against the rear of the front element 30.

Figure 4:
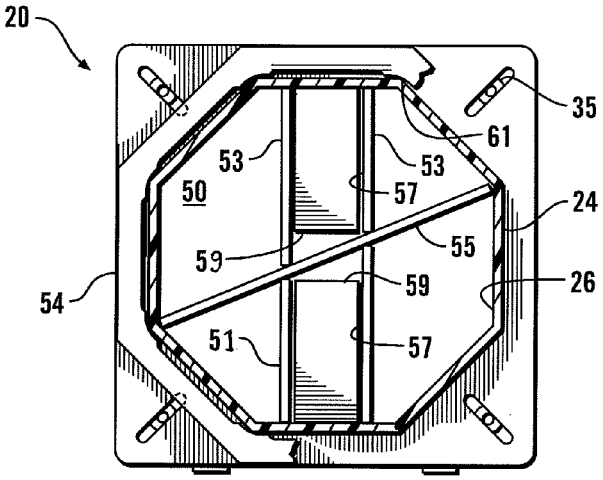
FIG. 4 is a cross-sectional view of the lid dispenser of FIG. 1, taken along section line 4-4.
Figure 5:
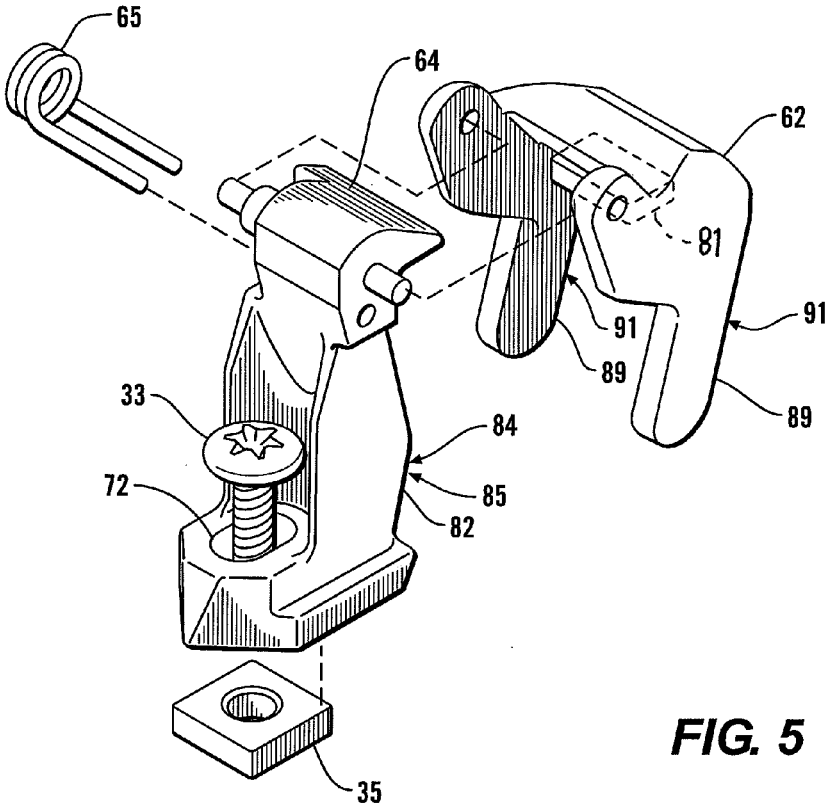
FIG. 5 is an enlarged exploded isometric view of one of the pager assemblies of the lid dispenser of FIG. 1.

The housing 24 is preferably a non-cylindrical tubular element having a polygonal cross-section, for example an octagon, such that the housing is comprised of three or more walls 31. The housing 24 thus cooperates with a non-round piston assembly 42 to restrict the rotation of the piston assembly. The piston assembly has a body 48 which has a forward wall 50 which may be of the same polygonal section as the housing 24, although somewhat smaller, so that it may smoothly travel along the tube while rotation is restricted. As shown in FIG. 1, the body forward wall 50 is octagonal, and has axially extending side walls 51 which project rearwardly from the front wall. As shown in FIG. 4, two pairs of parallel side walls 53 extend between the top and bottom housing walls 31. A transverse side wall 55 extends across the forward wall 50, and together with the parallel side walls 53 defines two spring compartments 57. The side walls 51 have outer edges which extend parallel to the walls 31 of the housing 24 and thereby restrict pivoting of the piston assembly body 48 such that the forward wall 50 can remain substantially perpendicular to the axis of the tubular housing 24 as it travels axially.

Two constant force springs 59 are retained within the spring compartments 57, such that the coiled bodies of the springs apply a forwardly directed axial force on the forward wall 50. The other ends of the springs 59 are fixed at the juncture of the tubular housing 24 and the front element 30. The springs 59 serve to urge the piston assembly 42 towards the opening of the front element 30. A circular nose plate 58 is fixed to a narrow diameter standoff member 60 which is fixed to the forward wall 50 of the body 48. The nose plate 58 is dimensioned to pass through the circular dispensing opening 40 of the front element 30. A stack 44 of lids 22, for example for beverage containers, shown in FIG. 6, is received within the tubular housing, and abuts against the piston assembly 42 nose plate 58. The piston assembly 42 thus serves to constantly urge the stack 44 of lids 22 towards the dispensing opening 40. It will be noted that the housing can accommodate lids of a range of diameters, so long as it is less than the diameter of the dispensing opening. The nose plate 58 will be selected to fit the dimensions of a particular lid 22, and the dispenser 20 can be configured for a different lid by replacing the nose plate with one of the proper dimensions. Even if the stack of lids is somewhat smaller in diameter than the interior dimensions of the housing, the dispensed lids are centered by the pager assemblies 34 as discussed more fully below.

The tubular housing 24 may be economically fabricated of a bent sheet of thin gauge plastic material, for example about 0.05 inches. The tubular housing 24 may be fabricated in extended lengths, for example over two feet. An external stiffening ring 54 may be provided, as shown in FIGS. 1 and 4. The ring 54 has radiused internal grooves 61 corresponding to each corner of the polygonal housing tube. The ring is slid into place along the tube at about the center of its length, and it serves to retain the tube in its desired shape.

Figure 2:
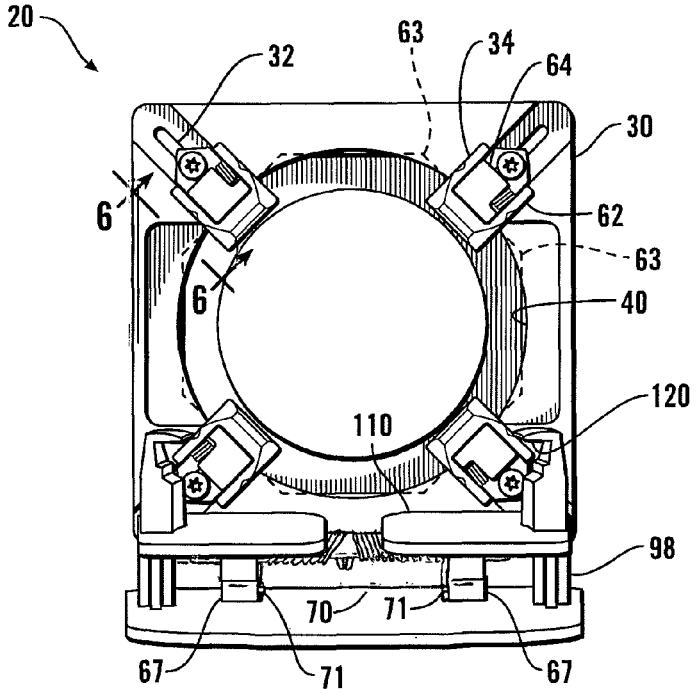
FIG. 2 is a front elevational view of the lid dispenser of FIG. 1, with the front door pivoted downwardly in a lid dispensing configuration.

The polygonal section of the tubular housing 24 cooperates with the circular dispensing opening 40 of the front element 30, as shown in FIG. 2. The circular opening 40 has a diameter smaller than the greatest width of the polygonal front wall. The diameter of the dispensing opening 40 is selected so that portions of each housing wall 31 are approximately tangent to the circular dispensing opening. As a result, the outer corners 63 of the housing extend radially outwardly beyond the dispensing opening. Therefore, the lids 44 and the nose plate 58 can pass freely through the dispensing opening 40, but the non-round piston assembly 42 cannot pass through and will abut against the front element 30. In this way a ready stop to excessive forward displacement of the piston assembly 42 is provided, without requiring an additional stop mechanism.

The dispenser 20 is loaded with a stack 44 of lids 22 by introducing the stack through the dispensing opening 40 in the front element 30. The four pager assemblies 34 each have a flipper 62 which is pinned to a pager body 64, and is urged into a forward orientation by a spring 65, shown in FIG. 5. Each flipper has a rearwardly facing resilient strip 81, shown in FIG. 6, which engages the lid. The resilience of the strip may vary to best suit a particular lid, for example a 45 durometer Shore A thermoplastic rubber element. Other materials of different hardness may be employed where appropriate. The flippers 62 extend outward over the dispensing opening 40, but are pressed out of the way by the incoming stack of lids to allow the stack 44 to enter the housing compartment 26. The stack of lids also depresses the piston assembly 42 to press the piston body 48 rearwardly to admit the stack of lids within the housing and to then exert a forwardly directed force on the stack of lids, urging the stack against the pager flippers 62 to be ready for dispensing, as discussed in greater detail below.

Figure 3:
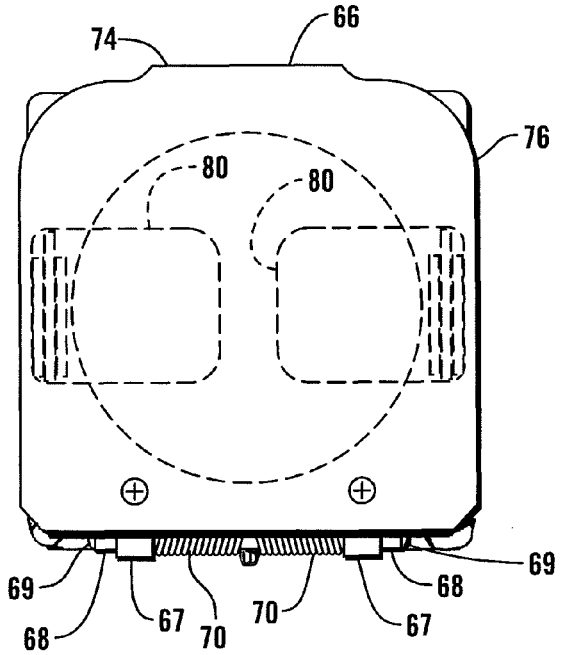
FIG. 3 is a front elevational view of the lid dispenser of FIG. 2, with the front door in a closed configuration, engaged with a lid ready to be dispensed.

As shown in FIGS. 2 and 3, the dispensing door 66 has two protruding ears 67 which are pivotably mounted about two screws 69 to two ears 68 which protrude frontwardly from the front element 30. The dispensing door 66 is urged into a closed position by two springs 70, shown in FIG. 1. As shown if FIG. 2, Each spring has one end which extends frontwardly and curves to engage a horizontal metal pin 71 which protrudes from a door ear 67 about an axis perpendicular to the housing axis, and another end which extends axially toward the housing, and engages the housing beneath the front element 30. The coiled portion of the two springs 70 encircle portions of the screws 69. The springs 70 urge the dispensing door into a closed position. Thus, a user overcomes the force of the spring to open the door 66, and when the door is released, the springs 70 return it to a closed configuration.

The dispensing door 66 is preferably formed of transparent plastic material to allow the lids 22 to be viewed through the door when it is closed, as shown in FIG. 3. The door 66 has an upwardly extending handle portion 74 which is gripped by a user when it is desired to extract a single lid. The door 66 has a middle portion 76 which is generally planar, and which abuts against portions of the housing extension 79 when the door is closed. As shown in FIG. 1, the molded plastic housing extension 79 is engaged in a snap fit with the front element 30. The housing extension 79 prevents access to the interior of the dispenser 20 when the door 66 is closed. For clarity, the housing extension has been omitted from the other views.

Two claws 80 are pivotably mounted to the dispensing door 66. The claws are mounted about pivot axes defined by screw fasteners 98. The pivot axes are coaxial. The claws 80 are spaced on opposite sides of the frontmost lid 22. As shown in FIG. 3, when the door 66 is closed on the housing, portions of the claws 80 engage the frontmost lid 22. When the lid is pivoted frontwardly the engaged lid 22 is pulled free of the pager flippers 62. The separated lid 22 is then presented to the user retained on the door 66 between the claws 80. When the user releases the door 66, after removing the dispensed lid, the springs 70 return the door to its closed position with the claws engaged behind the new frontmost lid, and the device is now ready to dispense another lid.

The claws 80 operate as follows to provide repeatable dispensing of individual lids. After a lid has been dispensed, or after the unit has been loaded with a fresh stack of lids, the dispensing door 66 is closed on the stack. When the door 66 closes, the depth stops 110 of the claws 80, shown in FIG. 2, engage against the foremost lid and depress the entire stack, thereby resetting the stack to a known position. The claw surfaces 120 of the claws are then engaged behind the flange of the frontmost lid. When the next user seeks to dispense a lid, the door 66 is pivoted frontwardly, causing the claws 80 to move frontwardly and pull the frontmost lid forward. Because of the pivotal mounting of the claws, they will remain parallel to the frontmost lid until the door 66 is opened so far that the claws can pivot no more. Because the claws are able to pivot, the claws are able to remain generally parallel to the lids over a long portion of the door travel, and this helps to evenly remove the frontmost lid from the pagers.

As shown in FIG. 2, the four pager assemblies 34 protrude radially inwardly in front of the dispensing opening 40 in the front element 30. The spring-loaded flippers 62 will pivot only towards the front element 30, to permit the stack of lids 44 to be inserted within the interior compartment 26 of the housing 24. The flippers do not pivot away from the housing. In order to remove a lid from its engagement behind a flipper, it must be deformed as it is pulled by the claws. It is important that the lids be centered within the four pager assemblies 34 to be presented properly to the claws. If the lid were not centered, it might not be engaged properly by both claws and not be dispensed at all. In addition, for economy it is important that a single dispensing apparatus can be configured to handle a variety of lids, to thereby respond to market and consumer needs. The prior art lid dispenser of U.S. Pat. No. 7,207,462, employed pager assemblies which were mounted to axially extending rods 82, as shown in FIG. 7. These rods served as guides to advance the lids onto the pager flippers which had interior surfaces facing the stack of lids which were at an angle $\alpha$ of less than 15 degrees with respect to a plane passing through the axis of the tube.

The present invention, as shown in FIG. 6, provides pager assemblies 34 which do not require rods, but which are adjustably positioned within the slots 32 and held in place by the fasteners 33. The tubular housing need not provide any space for axial rods, aiding its compact construction.

As shown in FIG. 6, the pager body 64 has a post 82 which extends frontwardly from the front element. The post 82 has an inside wall 84. One part of the inside wall 84 defines an engaging wall 85 which extends axially and radially inwardly, to define an inclined surface directed radially inwardly as it projects frontwardly. This wall is inclined at an angle greater than 15 degrees with respect to a plane extending through the axis of the housing, and may be up to about 45 degrees from such a plane. The flipper 62 is pivotally mounted to the post 82, and is biased to its radially inward position by a spring 65, shown in FIG. 5. Thus the flipper 62 will pivot out of the way when the stack of lids is pushed toward the housing interior compartment from the outside, but will resist movement when a lid is pulled frontwardly by the dispensing door 66 claws 80. The flipper 62 has two parallel wings 89 which extend on either side of the post 82, as shown in FIG. 6, such that the flipper can pivot and the wings clear the post. The wings 89 extend towards the front element. Each wing has an interior surface 91 which is inclined to project radially inwardly as it extends frontwardly. The interior surfaces 91 of the flipper wings 89 are inclined at an angle $\beta$ of preferably about 15 degrees or more with respect to a plane passing through the axis of the tube. The angle may be as small as 10 degrees. As shown in FIG. 6, the pager body post engaging wall 85 cooperates with the flipper wing interior surfaces 91 so that a stack of lids 22*a* (shown in broken lines) advancing from the housing interior compartment 26 is directed onto the flipper wing interior surfaces 91 so that the stack of lids 22 (shown in solid lines) is centered within the pager assemblies and presented in a controlled manner for engagement by the dispensing door 66 claws 80 for proper extraction of the frontmost lid. This arrangement avoids the possibility that an off-center stack of lids would abut the rearward edges of a flipper wing. The angle of the engaging wall 85 is preferably about 15 degrees, although it may be from 10 to 30 degrees, with respect to a plane intersecting the axis of the housing.

The pager assemblies are adjustably mounted to the front element for positioning in a desired radial position. When the assemblies are positioned such that the pager body posts project radially over the front element opening, each pager body post inside wall is positioned to engage lids which extend from the front element opening, and direct them towards engagement with the pager flippers. The inclined surfaces of the body post inside walls serves to prevent smaller lids from becoming caught on protruding portions of the pager posts. If the lids to be dispensed are sufficiently large that the pager assemblies are positioned so that the pager body posts do not project radially over the front element opening, then the walls 31 of the tubular housing themselves will be closely spaced from the lid stack, and will adequately serve to center the stack.

The lid dispenser 20 thus provides a compact arrangement for dispensing lids of a wide range of dimensions. The pager assemblies can be moved in the slots 32 over a range of ⅜ inches, which will accept lids over a ¾ inch range of diameters. The dispenser may be constructed in a variety of sizes to cover different ranges of lid diameters.

It is understood that the invention is not limited to the particular construction and arrangement of parts herein illustrated and described, but embraces all such modified forms thereof as come within the scope of the following claims.

I claim:

1. A lid dispenser comprising:

an axially extending tube defining an interior cavity configured to receive a stack of lids therein;

a front element fixed to the tube, the front element having an opening therein through which lids are dispensed;

a plurality of pager assemblies mounted to the front element to project frontwardly therefrom and to engage lids which pass through the front element opening, wherein each pager assembly comprises:

a pager body having a post which extends frontwardly from the front element, and having an inside wall having portions defining an engaging wall having an inclined surface directed radially inwardly as the inclined surface projects frontwardly; and a flipper pivotally mounted to the pager body post, and having at least one wing which extends towards the front element, and which has an interior surface which is inclined to project radially inwardly as the interior surface extends frontwardly, the flipper wing being biased radially inwardly, but being displaceable by a pressure applied axially towards the interior cavity, wherein the pager assemblies are adjustably mounted to the front element for positioning in a desired radial position, wherein when the assemblies are positioned such that the inclined surfaces of the pager body posts and the interior surfaces of the flippers project radially over the front element opening to engage lids which extend from the front element opening and direct the lids towards engagement with the pager flippers.

2. The lid dispenser of claim 1 wherein the flipper interior surface is inclined at an angle of greater than about 15 degrees with respect to a plane passing through the axis of the tube.

3. The lid dispenser of claim 1 wherein the tube has a polygonal cross section and is comprised of three or more walls.

4. The lid dispenser of claim 1 wherein the tube is formed of a thin sheet of material, the tube walls adjoining one another at a plurality of corners, and further comprising:

an external ring having internal grooves which engage each corner of the tube, the ring being disposed at a midpoint along the tube and serving to retain the tube in its desired shape.

5. The lid dispenser of claim 3 further comprising:

a forward wall;

a plurality of axially extending side walls which extend rearwardly from the forward wall;

at least one constant force spring, wherein one end of the spring is fixed adjacent the front element, and the other end is retained adjacent the forward wall, to urge the forward wall towards the front element; and a circular nose plate fixed to the forward wall to extend in front of the forward wall and disposed to engage a stack of lids retained within the tube.

6. The lid dispenser of claim 5 wherein the front element opening is circular, with a diameter smaller than the greatest width of the front wall, said diameter being larger than the diameter of the nose plate, such that the front element cannot pass through the front element opening, but the nose plate can.

7. The lid dispenser of claim 5 wherein the forward wall is of the same polygonal section as the tube, but smaller.

8. A lid dispenser comprising:

an axially extending tube defining an interior cavity configured to receive a stack of lids therein, the tube having a forward end;

a front element fixed to the tube, the front element having an opening therein through which lids are dispensed, wherein the tube forward end engages the front element;

a piston assembly disposed to urge the stack of lids through the front element opening;

a plurality of pager assemblies mounted to the front element to project frontwardly therefrom and to engage lids presented at the front element opening, wherein each pager assembly comprises:

a flipper pivotally mounted to a pager body post;

wherein the pager body post extends frontwardly from the front element, and has an inclined portion positioned to engage a lid exiting from the front element opening and direct the lid into engagement with the flipper; and wherein the flipper has at least one wing which extends towards the front element, and which has an interior surface which is inclined to project radially inwardly as the interior surface extends frontwardly, the flipper wing being biased radially inwardly, but being displaceable by a pressure applied axially towards the interior cavity, wherein the flipper wing receives and engages lids directed thereon from the pager body.

9. The lid dispenser of claim 8 wherein the flipper interior surface is inclined at an angle of greater than about 15 degrees with respect to a plane passing through the axis of the tube.

10. The lid dispenser of claim 8 wherein the tube has a polygonal cross section and is comprised of three or more walls.

11. The lid dispenser of claim 8 wherein the tube is formed of a thin sheet of material, the tube walls adjoining one another at a plurality of corners, and further comprising:

an external ring having internal grooves which engage each corner of the tube, the ring being disposed at a midpoint along tube and serving to retain the tube in its desired shape.

12. The lid dispenser of claim 10 further comprising:

a nonround forward wall;

a plurality of axially extending side walls which extend rearwardly from the forward wall;

at least one constant force spring, wherein one end of the spring is fixed adjacent the front element, and the other end is retained adjacent the forward wall, to urge the forward wall towards the front element; and a circular nose plate fixed to the forward wall to extend in front of the forward wall and disposed to engage a stack of lids retained within the tube.

13. The lid dispenser of claim 12 wherein the front element opening is circular, with a diameter smaller than the greatest width of the front wall, said diameter being larger than the diameter of the nose plate, such that the front element cannot pass through the front element opening, but the nose plate can.

14. The lid dispenser of claim 12 wherein the forward wall is of the same polygonal section as the tube, but smaller.

15. The lid dispenser of claim 1 wherein the inclined surface of the post is inclined at an angle of greater than 15 degrees with respect to a plane passing through the axis of the tube.

16. The lid dispenser of claim 8 wherein the inclined portion of the pager body post is inclined at an angle of greater than 15 degrees with respect to a plane passing through the axis of the tube.

* * * * *